United States Patent [19]

Sampson

[11] 4,316,618

[45] Feb. 23, 1982

[54] NON-EXPOSED SKI BINDING

[76] Inventor: Eric A. Sampson, 520 S. Harrison La., Denver, Colo. 80209

[21] Appl. No.: 121,997

[22] Filed: Feb. 19, 1980

[51] Int. Cl.[3] ..... A63C 9/08

[52] U.S. Cl. ..... 280/613; 280/633

[58] Field of Search ..... 280/611, 613, 607, 618, 280/633, 634

[56] References Cited

U.S. PATENT DOCUMENTS

| | | | |
|---|---|---|---|
| 3,764,154 | 10/1973 | Witting | 280/633 X |
| 3,771,806 | 11/1973 | Hinterholzer et al. | 280/613 |
| 3,834,723 | 9/1974 | Erlebach | 280/613 |
| 3,869,136 | 3/1975 | Jackson | 280/613 |
| 4,185,851 | 1/1980 | Salomon | 280/613 |
| 4,196,920 | 4/1980 | Salomon | 280/613 |

FOREIGN PATENT DOCUMENTS

| | | | |
|---|---|---|---|
| 14085 | of 1908 | United Kingdom | 280/618 |

*Primary Examiner*—Richard A. Bertsch
*Assistant Examiner*—Michael Mar
*Attorney, Agent, or Firm*—Robert C. Dorr

[57] ABSTRACT

A symmetrical non-exposed ski binding operative to engage the ball and tibial axis areas of a ski boot to a ski. The ski binding includes two downwardly protruding spheres operatively connected to the sole of a ski boot in the ball and tibial axis areas thereof for matingly engaging symmetrical arcuate tracts formed in the ski. Each arcuate tract is biased and is capable of releasing each sphere in any direction in the plane of and above the surface of the ski when predetermined release forces are exceeded.

18 Claims, 17 Drawing Figures

350
340
360
334
336
370
30
310
300
20
332
330
336
334
320

400
20
410
310
30
420

NON-EXPOSED SKI BINDING

BACKGROUND OF THE ART

1. Field of the Invention

The present invention relates to ski bindings and, in particular, to a ski binding which is entirely disposed between the sole of a ski boot and a ski.

2. Discussion of Prior Art

Numerous prior art ski binding approaches exist. The most common is termed the "toe-heel" binding. Examples of these types of bindings are those manufactured by AMF under the trademark TYROLIA, those sold under the trademarks GEZE and SALOMON 727. The last mentioned ski binding was evaluated in "Bindings Performance Report: The Salomon 727" by Cart Ettlinger, SKIING, 1978, pages 196–201. In this article, the Salomon 727 is praised because it is more sensitive to twist and upward release forces at the toe, it demonstrates more anti-shock characteristics, and is a more compact model which will not catch on obstacles such as brush while skiing. Furthermore, the Salomon 727 was found to minimize the effects of snow accumulation under the boot sole.

These conventional toe-heel bindings consist of a tension mechanism at the front of the boot that controls lateral motion and release and a heel unit which is placed at the rear of the boot and controls vertical motion and release. Different manufacturers have incorporated differing mechanical devices to achieve these results, but all basically operate with similar characteristics.

The other major conventional binding design is the plate binding which gets its name from a solid plate under the boot connected typically at two contact points. Usually the plate is attached to the full length of the ski boot and extends beyond the boot toe and heel. The plate then attaches to contacts on the ski at the toe and heel area that secures a plate to the release mechanism. Such bindings typically offer better release, but have limited anti-shock and ski control.

Another type of prior art approach exemplified by the SPADEMAN SYSTEM manufactured by Spademan Release Systems, P.O. Box 6410, Incline Village, Nev., relates to a ski binding which engages the sides of the sole at the heel, but not the toe.

All of the above prior art approaches are generally characterized as external bindings in that these bindings engage some portion of the periphery of the ski boot. Inherently, they all capture snow and debris since they outwardly extend. Furthermore, all of the prior art approaches which require two separate contact points have different types of bindings at these points. For example, different bindings for the toe than for the heel. These non-symmetric bindings are expensive to manufacture and the different binding portions have different release characteristics.

And, all of the above prior art approaches significantly affect the flex characteristics of the ski. This is due to the substantial portion of each binding which is rigid. Because of their design these prior art approaches have the ski boot disposed some distance above the surface of the ski causing the skier to have a higher center of gravity.

Most importantly, from a release viewpoint, it is impossible for such prior art bindings to release in any given direction above the plane of the ski. Such bindings must mechanically translate the environmental force causing the release into a programmed direction of release.

A need exists for a ski binding which overcomes the above difficulties.

The present invention relates to a different type ski binding, one that is internal between the ski and ski boot and one that engages the ball area and tibial axis areas of the boot. These are significant areas of engagement since the weight of the skier is concentrated at these two points. The maximum control over the ski occurs at these two points. In such an internal configuration, there are no barriers existing that the boot must go around in order to release such as found in conventional bindings. Furthermore, the possibility of the boot getting stuck or jammed on a release mechanism, thereby inhibiting a release, is eliminated.

By utilizing an internal design, the flex pattern of the ski can be substantially maintained. This will allow the ski to deliver optimum performance with the binding of the present invention as opposed to having the binding disturb the natural flexation of the ski.

The ski binding of the present invention is designed to improve anti-shock by allowing both the ball and tibial axis areas of the boot to work together in both anti-shock and release functions. Both the ball and tibial axis binding units work in unison to help reduce shock faster and to provide for a smoother release should one be needed. By allowing the binding to move in a natural motion with the boot, efficiency is increased. In comparison to conventional approaches, such unison-like movement is inhibited. Specifically, toe bindings on conventional approaches are fixed into position and do not move forward along the longitudinal axis of the ski. Specifically, conventional approaches provide different mechanisms for anti-shock and release performance. The present invention, however, utilizes the combined anti-shock and release system as one function to realize faster anti-shock return and greater control.

The present invention utilizes two symmetric arcuate channels that are multi-functional in purpose. The major functions of the tracts are to provide anti-shock and release capabilities. Each tract, however, has formed grooves to help the ski boot recenter itself quickly and efficiently. The grooved channels are also designed to facilitate release when travel has exceeded a predetermined limit. The channel is designed to provide a smooth release by allowing the mechanism to exit freely. Each channel is designed to be arcuate thereby allowing the boot to move about its natural axis both at the ball and tibial axis areas of the boot. This enables the boot to move in a natural motion during a release thereby preventing unnecessary strain on the leg which is conventionally found in other bindings. Hence, the ski binding of the present invention is capable of releasing the boot from the ski in any direction above the plane of the ski even in the direct upward or upward twisting motion.

For example, in the Tyrolia 360D binding, a swinging translation occurs before release. The present invention does not have to undergo a swing to release and can release freely in any direction. Yet, the present invention maintains a high return to center force which is adjustable as are conventional approaches. In the ski binding of the present invention, the front and rear bindings have the same release characteristics.

From a manufacturing and use viewpoint, the ski binding of the present invention is designed so that both the ball area and tibial axis area bindings are identical to each other and are symmetric. Conventional approaches utilize different mechanical configurations at the toe than is found at the heel.

The ski binding of the present invention minimizes any gap between the sole and the upper surfaces of the ski thereby eliminating snow build-up. Furthermore, because of the lack of a gap between the boot and the ski, there is an overall lower center of gravity with the binding of the present invention than any conventional binding.

The present invention, in one embodiment, utilizes a flexible plate that attaches the boot to the ski. Previously, all plates that have been utilized have been extremely rigid. By utilizing the flexible plate and fixation at the ball and tibial axis areas of the boot, the boot will move with the ski in natural motion and not against it. Furthermore, because the plate is flexible, the boot rests almost directly on the ski top which provides excellent purchase with the ski and feedback to the skier.

By utilizing a flexible plate, and for those skiers who desire it, the plate can be easily canted either when they are manufactured, or by placing them on a plate at a later time. The canting process will not effect the bindings of the present invention that is common with most other bindings.

OBJECTS OF THE INVENTION

It is an object of this invention to provide a new and novel ski binding which affixes to the ski boot in the ball and tibial axis areas thereof.

It is another object of this invention to provide a new and novel ski binding which utilizes a symmetrical front and rear portion.

It is another object of the present invention to provide a new and novel ski binding which is located between the sole of the ski boot and a ski.

It is another object of the present invention to provide a new and novel ski binding which is capable of releasing in any direction above the upper plane of the ski including a direct upward rearward fall.

These and other objects of the present invention will be found in the following specification.

SUMMARY OF THE INVENTION

Figures 1, 2:
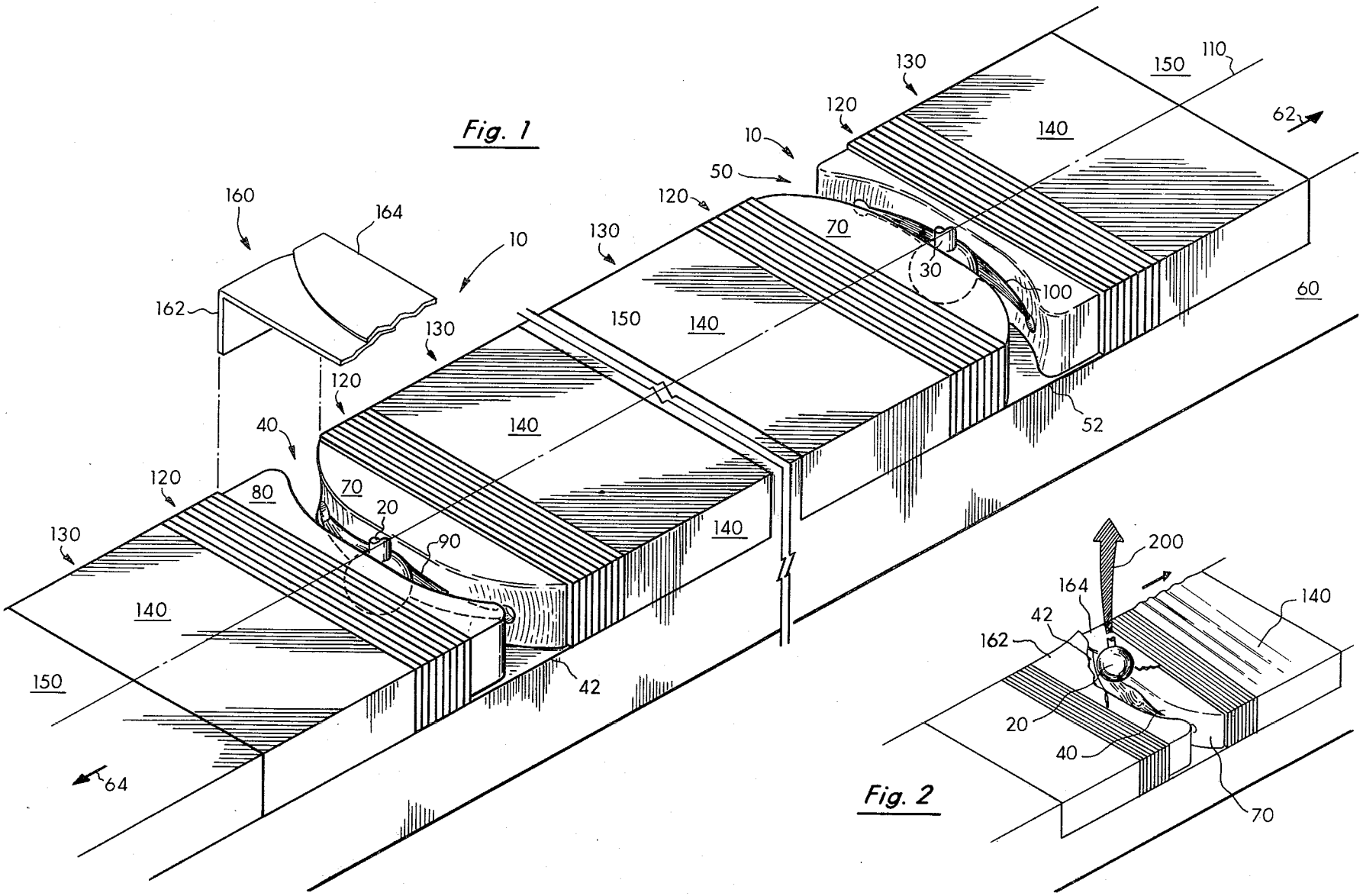
FIG. 1 is a partial perspective view showing the ski portion of the binding of the present invention.
FIG. 2 is an illustration showing the release of a sphere from the ski portion of the binding of the present invention.

The ski binding of the present invention operatively releases a ski boot from a ski when the environmental forces on the ski from skiing exceed a predetermined amount. The ski binding includes a pair of downwardly extending spheres from the boot which engage two symmetric arcuate tracts in the ski. The arcuate tracts are capable of moving to provide anti-shock control, centering return, and release.

The first sphere downwardly extends from the boot in the ball area of the boot and is located along the longitudinal axis of the boot. The second sphere also downwardly extends from the boot in the region of the tibial axis of the boot and is also located along the longitudinal axis.

Each arcuate tract is mounted in a formed recess in the upper surface of the ski which is formed by a concave tract member and on opposing convex tract member. Each tract member is biased toward the other tract member by a plurality of coil springs. A centering groove is formed on each tract member so that when a sphere is disposed in the centering groove, the sphere is quickly returned to the longitudinal center of the ski by the coil springs. Each sphere is capable of traveling in the tract a predetermined distance as long as the environmental forces from skiing are less than a predetermined release force but greater than a predetermined travel force. Upon removal of the environmental forces, the sphere connected to the ski boot is rapidly returned towards the longitudinal center of the ski. However, when the environmental forces exceed a predetermined release force, the sphere is capable of releasing in any direction above and to the sides of the ski.

DETAILED DESCRIPTION

1. General Operation

The ski binding 10 of the present invention is generally shown in FIGS. 1 through 5. The binding 10 includes two downwardly protruding spheres 20 and 30 which are operatively connected to a ski boot and which matingly engage into arcuate tracts 40 and 50. Each arcuate tract 40 and 50 is formed in recesses 42 and 52 of a conventional ski 60 having a tail 62 and a tip 64. Each arcuate tract 40 and 50 is symmetrical and identical to each other and each have a convex member 70 and a concave member 80. Convex and concave members 70 and 80 are biased towards each other in the recesses 42 and 52 of the ski 60 in order to from the arcuate tracts 40 and 50. The spheres 20 and 30 are firmly held in a convex centering groove 90 formed in each convex member 70 and a corresponding concave centering groove 100 formed in each concave member 80.

In normal use, i.e., when the environmental forces from skiing are low, the two spheres 20 and 30 are held in the longitudinal center 110 of the ski 60 by the arcuate tracts 40 and 50. Each sphere 20 and 30, however, is capable of limited movement or travel in its respective arcuate tracts 40 and 50 along the tracts in the formed grooves 90 and 100. This traveling movement occurs when the environmental forces from skiing exceed the aforesaid normal forces. For clarity such forces are termed "traveling forces." The binding 10 is designed to quickly return the spheres 20 and 30 to the longitudinal center 110 upon removal of these traveling forces. However, and as will be explained subsequently, when the traveling forces from skiing exceed predetermined levels (depending on the angle of release) the spheres 20 and 30 will be ejected outwardly from the sides of the binding or upwardly in any direction above the ski. These latter forces are termed "release forces."

As mentioned, the spheres 20 and 30 are also operative to release from the arcuate tracts 40 and 50 in any angle above the plane of the ski 60. This is best shown by reference to the illustration in FIG. 2 which shows the convex member 70 being moved rearwardly in the recess 42 thereby opening up the tract 40 in order to release the sphere 20 in the direction of arrow 200. The amount of the predetermined release force is a function of the angle of release and is also determined by the number of spacers 120 which are disposed between the member 70 and 80 and the biasing means generally designated as 130. By adding more spacers 120, the tension of the convex and concave members 70 and 80 on the spheres 20 and 30 increases thereby increasing the release force necessary to eject the spheres 20 and 30 from their respective tracts 40 and 50.

A flexible vinyl-like material 140 is disposed over the biasing means 130 and is flush with the upper surface 150 of the ski 60. This prevents any snow or moisture from building up and interfering with the biasing means 130 which are disposed under the covering 140 and which will be described in further detail subsequently.

Also disposed over each arcuate tract 40 and 50 is a flexible shield 160 comprising two half-sections 162 and 164 which engage each other in overlapping relationship. This shield prevents snow or ice from building up in the arcuate tracts 40 and 50 and does not interfere with the operation or release of spheres 20 and 30.

2. Boot Portion of the Binding

Figures 3, 4:
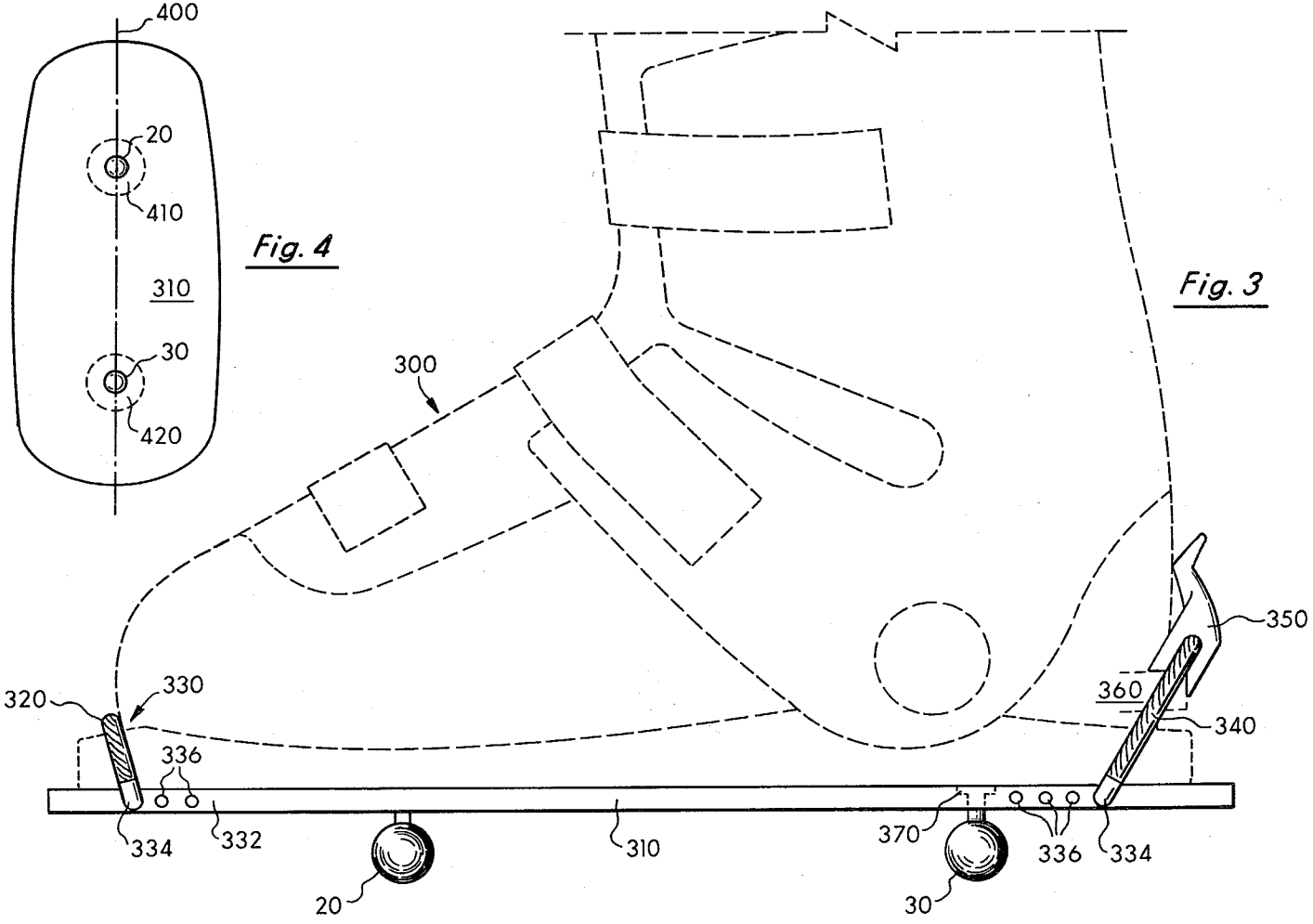
FIG. 3 is a side planar view of the boot plate of the present invention.
FIG. 4 is a bottom planar view of the boot plate of the present invention.

In FIGS. 3 and 4 are shown a first embodiment of operatively affixing the spheres 20 and 30 to a ski boot 300. A flexible plate manufactured from plastic or the like 310 is formed in the substantial shape of the sole of the ski boot 300. A metal cable 320 engages the toe 330 of the ski boot 300 and is affixed to the sides 332 of the plate 310 by means of clips 334. A plurality of holes 336 are formed to allow for adjustments of the clip 334 for different sized boots 300. A heel cable 340 is correspondingly affixed by means of clips 334 to holes 336 in the rear of the plate 310. A plastic-like engager 350 is conventionally used to engage the heel 360 of the boot 300 to the plate 310. The spheres 20 and 30 are permanently affixed to the plate 310 by means of a rivet 370 or the like. The plate 310 is flexible enough so that the skier can feel the ski through the boot in order to obtain feedback as to the flexing of the ski.

As shown in FIG. 4, the flexible plate 310 has a longitudinal axis 400 which corresponds to the longitudinal axis of the boot 300 upon which the spheres 20 and 30 are oriented. Furthermore, sphere 20 is centered in the ball area 410 of the boot 300 and sphere 30 is centered in the tibial axis area 420 of the boot 300. The ball area of the boot 300 corresponds to the region underneath the ball of the foot of the user and the tibial axis area 420 corresponds to the area of the boot directly under the axis of the tibial bones of the user. These two areas 20 and 30 are the primary support areas by the boot 300 for the user.

Figures 5, 6, 17:
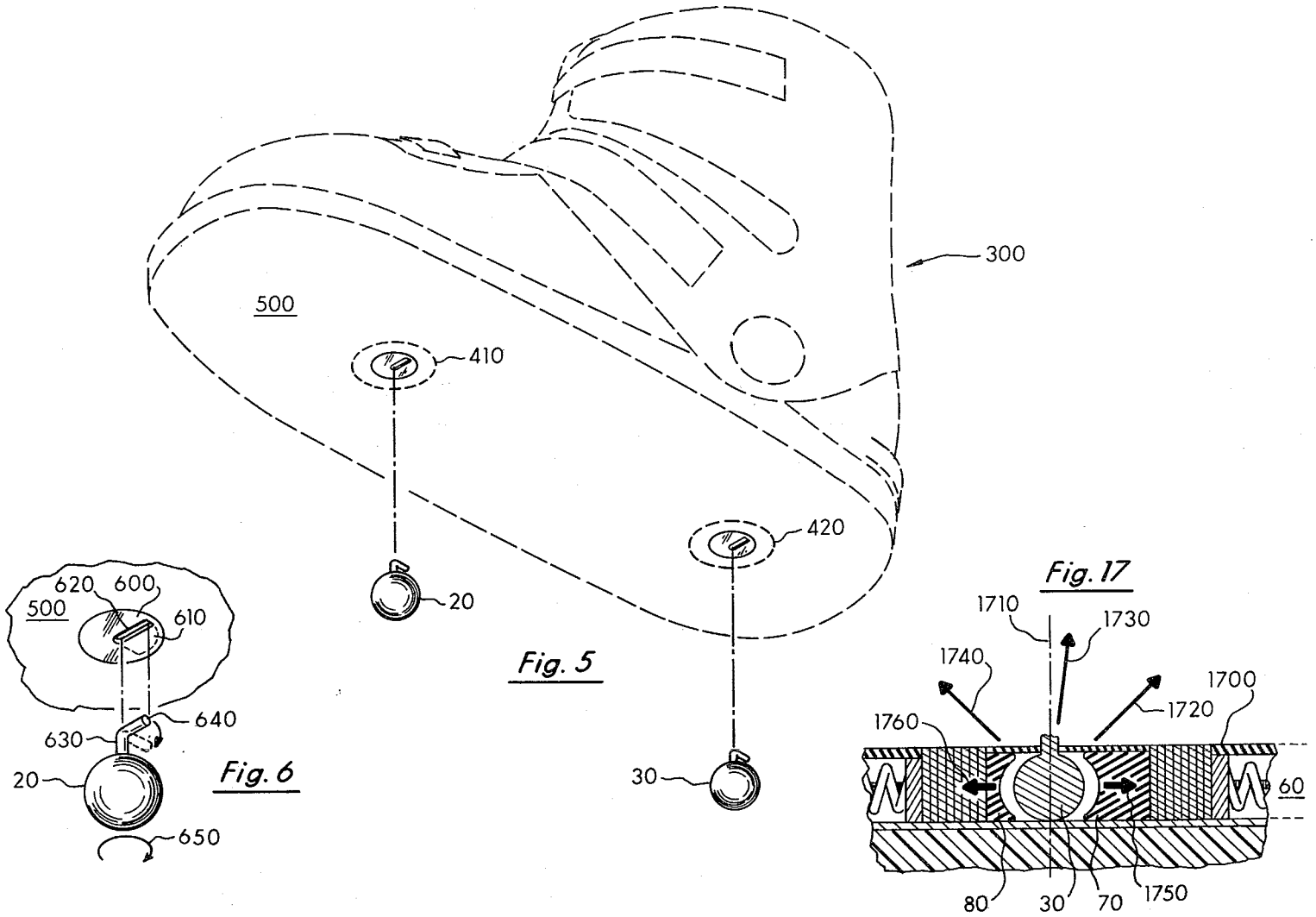
FIG. 5 is a perspective view showing the insertion of the spheres of the present invention to a ski boot.
FIG. 6 sets forth the details shown in FIG. 5.
FIG. 17 is an illustration showing the release of the sphere of the present invention in any direction above the plane of the ski.

FIGS. 5 and 6 show another embodiment for affixing the spheres 20 and 30 to the ski boot 300. In FIGS. 5 and 6, a circular plate 600 is inserted into the actual sole 500 of the boot 300 and is glued or molded therein. This plate has a formed recessed cavity 610 and a slot 620. Each sphere has an upstanding cylindrical portion 630 containing a right angled key 640. The key 640 engages slot 620 and the entire sphere is turned in the direction of arrow 650 to firmly engage the boot 300. The spheres 20 and 30 engage the channel 610 to be locked into place as for example by friction. Again, each sphere 20 and 30 is located in its respective ball area 410 and tibial axis area 420 of the boot 300.

The two embodiments for affixing the spheres 20 and 30 to the ball area 410 and tibial axis 420 of the ski boot 300 shown in FIGS. 3 through 6 are representative of the preferred embodiments. However, other approaches for performing this affixation could be utilized according to the teachings of the present invention. In both preferred embodiments, it is readily apparent that significant feedback and purchase exists between the boot 300 and the ski 60. In the embodiment shown in FIGS. 5 and 6 the sole of the boot actually engages the upper surface of the ski.

Furthermore, the binding 10 of the present invention is operatively connected to those areas of the boot 300 that carries or supports the full weight of the user—i.e., the ball area 410 and the tibial axis area 420. This latter factor becomes important when release occurs—i.e., release occurs at the point of weight support and, therefore, twisting and leverages found especially in toe and heel bindings are substantially minimized. Another advantage in having correction in these areas is found in the greater control over the ski by the skier. In controlling the edges of the ski, the skier's boot is in actual contact with the edge whereas in conventional approaches, the skier's boot is disposed above the surface of the ski and in order to translate an edge control the force, in conventional approaches, must be translated through the toe and heel.

When released from the binding, the skier can remove the flexible plate 310, in the embodiment of FIGS. 3 and 4, or remove each individual sphere, in the embodiment of FIGS. 5 and 6, and walk normally in the ski boot.

Finally, the ski binding of the present invention is readily adaptable to any ski boot. Conventional bindings, to the contrary, must fit standardized DIN boots or else they will not fit.

The Ski Portion of the Binding

Figure 8:
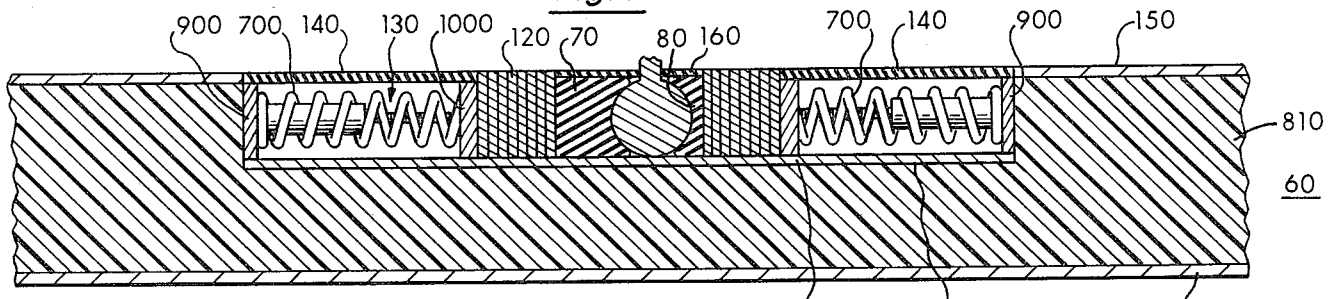
FIG. 8 is a cross-sectional view of the ski binding shown in FIG. 7.
Figure 7:
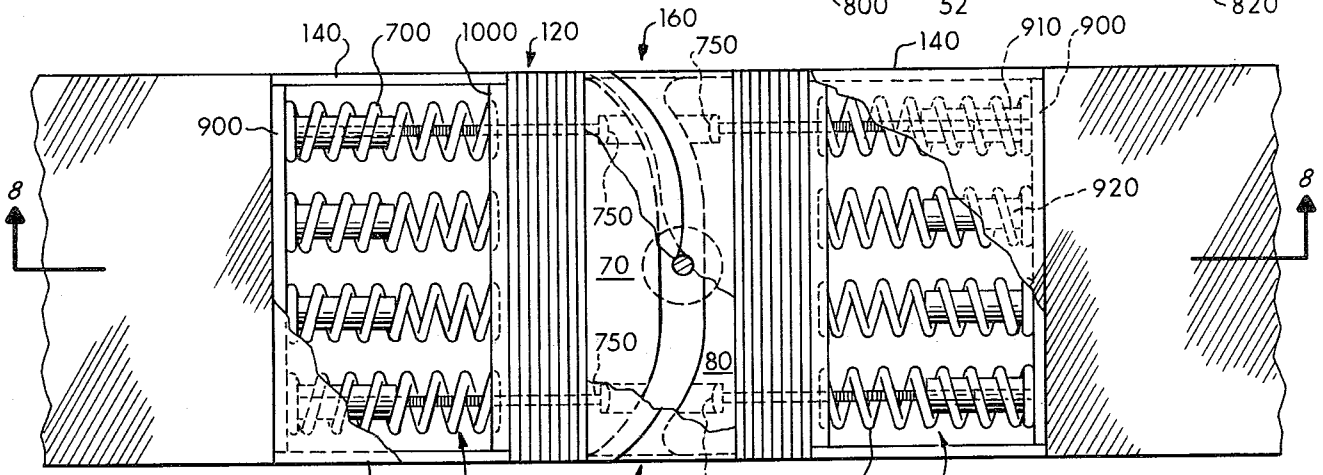
FIG. 7 is a top planar view of the ski portion of the binding of the present invention.

In FIGS. 7 and 8 are shown the preferred embodiment of the biasing means 130 of the present invention. In the preferred approach, four coil springs 700 are used to bias the spacers 120 against the respective convex and concave members 70 and 80.

For purposes of discussion, the single binding shown in FIGS. 7 and 8 will be the binding located in recess 52 of FIG. 1. First, a rectangular plate 800 is inserted into the bottom of a formed recess 52 to provide reinforcement to the core 810 of ski 60. Typically the core 810 is made from wood or plastic foam and the recess occupies 30–40 percent of the width of the core. The reinforcement plate 800 can be affixed by gluing the plate to the core material. The reinforcement plate 800 can be rigid or flexible and can be tailored to match the flex characteristics of the ski. As can be observed, the binding of the present invention does not substantially affect the flex characteristics of the ski as do conventional bindings. The base of the ski 60 is shown as surface 820.

Figure 9:
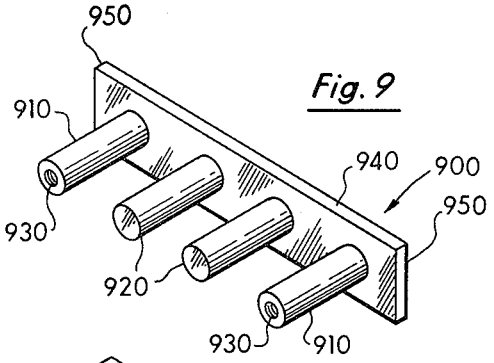
FIG. 9 is a perspective view of the anchor plate of the present invention.

On opposing ends of the recess 52 are anchor plates 900 which are shown in greater detail in FIG. 9. Anchor plates 900 are rectangular pieces of metal or plastic which are glued or affixed in an orientation which is perpendicular to the reinforcement plate 800 and against the core material 810 on opposing ends of the recess 52. Riveted and outwardly extending on each of the anchor plates 900 are four metal posts 910 and 920 spaced apart from each other. Posts 910, as shown in FIG. 9, have threaded holes 930 formed therein on one end. The diameter of the posts can be varied as desired to provide more or less strength.

The coil springs 700 have one end of each spring mounted over the posts 910 and 920. As can be observed in FIGS. 7 and 8, the coil springs 700 have an inner diameter slightly greater than the outer diameter of each post 910 and 920. Although four springs are shown, more or less springs may be utilized. Furthermore, while the preferred embodiment uses springs having the same spring constant, the springs could be tailored to have different patterns of tension.

Figure 10:
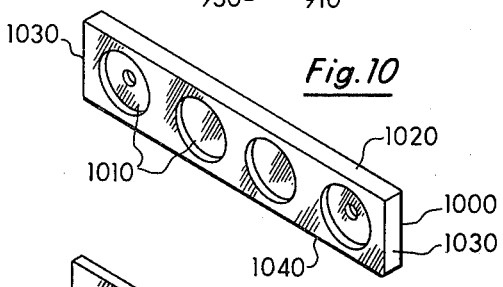
FIG. 10 is a perspective view of the cup plate of the present invention.

The opposite end of each coil spring 700 engages a rigid metal cup plate 1000 as illustrated in greater detail in FIG. 10. The cup plate 1000 has four circular cavities 1010, each having a diameter slightly larger than the outside diameter of the coil spring 700 so that each coil spring can positively seat in the cavities 1010 as shown in FIGS. 7 and 8. The outer cavities have a formed hole disposed therethrough.

A vinyl-like flexible covering 140 is glued along the top surface 1020 and edges 1030 of the cup plate 1000 and is correspondingly glued to the top edge 940 and side edges 950 of the anchor plate 900. This vinyl-like covering 140 prevents snow or ice or dirt from building up around the coil springs 700.

As previously mentioned, the anchor plate 900 is glued into the recess 52. However, the cup plate 1000 is able to travel along the upper surface of reinforcement plate 800 upon compression of the springs 700. It can be appreciated by viewing FIG. 8, that each spring 700 is disposed a predetermined distance above the reinforcement plate 800 and a predetermined distance below the vinyl covering 140 to allow the spring to freely compress.

Figure 11:
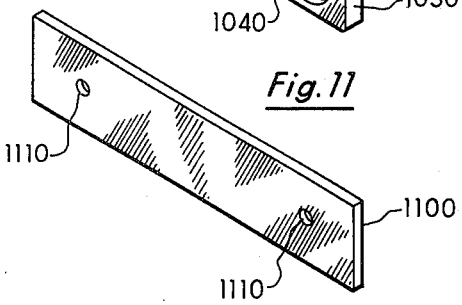
FIG. 11 is a perspective view of a spacer of the present invention.

The spacers 120 abut against the cup spacer 1000. An individual spacer 1100 is shown in FIG. 11 to comprise a rectangular rigid metal or plastic piece having two pre-formed holes 1110 formed therein on opposing ends. The spacers 120 are larger in rectangular area than the cup spacer 1000. This is so that all surfaces along the sides and top of the ski will be flush.

The convex and concave members 70 and 80 respectively abut against their corresponding set of spacers 120. Threaded screws 750 engage the holes 1110 of the spacers 120 and holes 1032 of cavities 1010, pass through the center of the two outer springs 700 and engage the threaded holes 930 on posts 910 of anchor plates 900. These threaded screws 750 hold the members 70 and 80 against the plurality of spacers 120 and springs 700.

The anchor plate 900, the support posts 1910 and the screws 750 are of sufficient structural strength to hold the biasing mechanism 130 together as shown in FIGS. 7 and 8. Additional structural strength can be had by providing additional threaded screws, not shown, through the inner two springs in the same arrangement as previously discussed.

As shown in FIGS. 7 and 8, a shield 160 is provided over the arcuate tract 40 by gluing to the upper surface of the members 70 and 80. In the final assembly, all surfaces around the binding merge into the outer walls and top surfaces of the ski 60. Furthermore, the binding 10 of the present invention is secure from ice, snow or dirt build up.

As can be seen in FIGS. 7 and 8, the orientation of the arcuate tract 40 in relation to the ski 60 can be longitudinally adjusted by adding or subtracting spacers 120. This is accomplished in the following manner. The adjustment occurs by moving one of the members 70 and 80 against its respective biasing means 130 and inserting a tool to loosen screws 750 on the opposing member. These screws can be removed and spacers 120 can be added or subtracted, accordingly. Furthermore, not only can the arcuate tract 40 be moved with respect to the ski 60 for different sized boots, the tension in the tract 40 can be increased by adding spacers on either side. These spacers can vary in size typically from 1/16" to 1/32".

Figure 12:
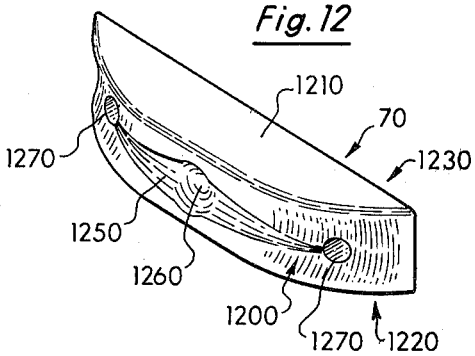
FIG. 12 is a perspective view of the convex tract member of the present invention.
Figure 13:
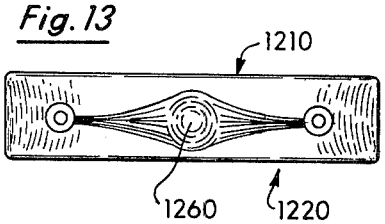
FIG. 13 is a front planar view of the tract member of FIG. 12.
Figure 14:
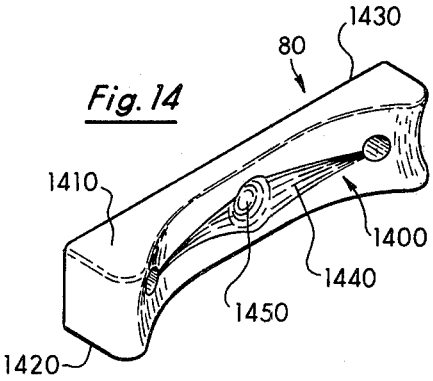
FIG. 14 is a perspective view of the convex tract member of the present invention.
Figure 15:
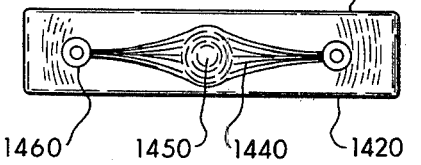
FIG. 15 is a front planar view of the tract member of FIG. 14.

In FIGS. 12 through 15 are shown the details of the convex members 70 and the concave members 80. In FIGS. 12 and 13, the convex member 70 is generally an arcuate shaped piece formed from durable plastic having a convex surface 1200, a flat upper surface 1210, a flat bottom surface 1220 and a flat vertical back 1230. On the convex surface 1200 is formed a centering groove 1250. The centering groove has a partial spherically shaped cavity 1260 formed in its center. Holes 1270 are also formed to allow passage of the screws 750.

Correspondingly, the concave member 80 has a concave surface 1400, flat upper and lower surfaces 1410 and 1420, respectively, and a vertical flat back 1430. A centering groove 1440 is longitudinally disposed in the center of the concave surface 1400 and has a partial spherically shaped cavity 1450. Holes 1460 are formed through the concave member 80 to receive screws 750.

The centering grooves 1250 and 1440 directly oppose each other and are formed to receive spheres 20 or 30 and, hence, the grooves are generally curved inwardly to receive, in cooperation with each other, substantially the outer surface of the sphere. The centering grooves 1440 and 1250 are designed to cooperate with the biasing means and spheres 20 and 30 as set forth in FIG. 16.

While the above represents a preferred embodiment, many other structural approaches can be utilized to provide the biasing. For example, different types of springs, such as leaf springs, may be utilized. In addition, and by way of example, the spheres of the present invention could be mounted to a ski and the above described biased release mechanism could be modified to mount on or in the sole of the boot. And, the release mechanism could be further modified to fit on the upper surface of the ski through use of a suitable housing to replace the recess.

4. Operation of the Binding

In operation, the ski binding 10 of the present invention performs differently when three different types of environmental forces due to skiing are present. Under normal skiing forces, the spheres 20 and 30 are oriented in the arcuate tracts 40 and 50 along the longitudinal axis 110 of the ski 60. When the environmental forces exceed these normal forces, the sphere is capable of sidewards movement in the grooves 1440 and 1250. As these "traveling forces" subside, the centering grooves and the tension from the biasing mechanism quickly returns the sphere (and, thus, the boot) to the longitudinal center 110. However, when a "release force" is encountered (being greater than a predetermined amount of traveling force), the spheres are released from the tracts.

Figure 16:
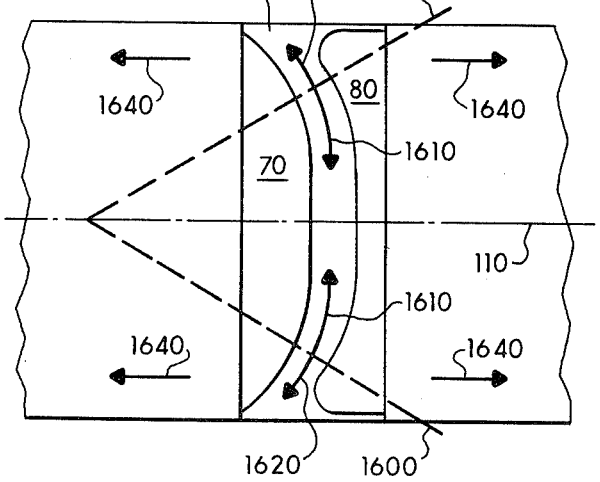
FIG. 16 is an illustration showing the positions for release in the plane of the ski.

In FIG. 16, the tract 50 is disposed between the concave member 80 and the convex member 70. As long as the sphere is between the area indicated by the dotted lines 1600 it will return to the longitudinal 110 of the ski. Hence, should the sphere travel to lines 1600 under a traveling force in either direction, it will move back towards the center in the direction of arrows 1610 upon removal of the traveling force. This is a rapid return due to the slope of the grooves and the force from the springs. On the other hand, should the sphere move beyond line 1600 under a release force, it will be snapped out of the tract 50 in the direction of arrows 1620. This is a positive release. It is important to keep in mind that the discussion for FIG. 16 relates to only one plane of movement—i.e., in the surface plane of the ski. In this plane of movement, the sphere forces the members against the biasing means in the direction of arrows 1640. The arcuate shape of the binding is such that if the ball area of the boot pivots about the ski, the tibial axis sphere will travel in a normal arcuate path. The same holds true for the ball area pivoting about the tibial axis area. Indeed, when both pivot, both the tibial axis area and the ball area of the boot translate in the arcuate tracts. This natural translation is not evidient in prior conventional approaches which tend to fix the translation to be lateral or longitudinal. Hence, the radius of these arcs is substantially the distance from the center of the ball area of the boot to its tibial axis area.

In FIG. 17, ejectment of the sphere under a release force can also occur in any three-dimensional orientation above the surface of the ski 60. The surface of the ski is defined in FIG. 17 as plane 1700. A plane perpendicular to plane 1700 passing through the center of the sphere is designated 1710. The sphere depending upon the appropriate forces can release in the direction of arrows 1720, 1730 and 1740. These are only examples of release. In doing so, the respective members 70 or 80 will move in the direction of arrows 1750 or 1760. Upon inspection, therefore, of FIG. 17 the twisting upward releases and direct backward release which pose substantial difficulties for conventional bindings are solved with the present invention. The amount of release force in any given direction necessary to effectuate release will vary dependent upon the angle of release, the shape of the grooves, and the amount of biasing force. In the preferred embodiment the amount of force necessary to release in a direct upward fall would represent a minimum release force as compared to the force for a lateral release.

The release of the sphere is also substantially natural. In other words when a force is exerted on the boot, the boot will release in that direction without having vectors or directional translations occurring as are found in substantially all conventional bindings. Indeed conventional approaches use a variety of mechanical devices such as rollers and cams to effectuate such translations. Conventional bindings are highly restricted in their angles of release.

Assume, that FIG. 17 represents the mating relationship between the sphere 20 and the arcuate tract 40 located in the ball area of boot 300. It is apparent that environmental forces to the ski 60 which create shock forces which are less than the release forces are readily absorbed in the direction of arrows 1750 and 1760 of springs 700. This provides anti-shock control for the sphere 30 and permits limited travel in the direction of arrows 1750 and 1760. The amount of shock absorber effect is clearly dependant upon the number of spacers 120 inserted. At one extreme, if too many spacers are inserted, there will be little anti-shock effect and at the other extreme if too few spacers are provided there will be no purchase or control between the boot and the ski. A desired middle range is dependant upon the characteristics of the ski and the desires of the skier. Slight vertical movement of the sphere in the tract is also permitted before release occurs. This is desirable in ski binding design.

When FIG. 17 is taken in conjunction with FIG. 16, it can be readily observed that the sphere 30 can release in any direction above the plane 1700 of the upper surface of the ski 60. Furthermore, it is readily apparent that the bindings of the present invention have significant anti-shock characteristics.

It can also be observed in FIG. 17, that the above applies equally as well for the tibial axis are of the boot 300. Again, release is effectuated in all directions and again anti-shock characteristics are evident. In conventional bindings, free play is common at the heel which results in loss of contact and control. The binding of the present invention at the tibial axis area is positive (no free play) thereby providing excellent control and contact.

Significantly, the ball area and the tibial axis area of boot 300 enjoy a large amount of purchase with the ski. Furthermore, the point of release of the boot and the ski is at the point of maximum support by the ski for the person in the boot. This is true because the weight of the person is found in the ball area 410 and the tibial axis 420 of ski boot 300.

Another feature of the binding 10 of the present invention is the symmetry of the ball and tibial bindings, both are identical in structure and function. Under environmental forces, the boot moves in uninhibited reaction in relation to the ski. Conventional bindings do not. For example, in a conventional toe-heel binding, the boot cannot move in the direction along the longitudinal axis of the ski toward the toe binding. Such conventional toe bindings are designed to be fixed in that direction and are designed to translate that force diagonally out to the sides of the ski. With the binding of the present invention, it is clear that no such translation occurs and that the ball area and tibial axis area of the boot can react in any direction in the plane 1700 of the ski under shock forces.

The ski binding of the present invention is totally internal being located between the sole of the boot and the ski and, therefore, will not catch on any obstacles such as brush. Furthermore, no gap is formed between the boot and the ski thereby eliminating snow build-up and lowering the skier's center of gravity.

While the present invention has been described in detail with two preferred embodiments, the teachings of the present invention can embrace many other structural approaches. Some of these structural approaches have been set forth above. However, the present invention is not to be limited to these variations as it can embrace a large number of different embodiments.

I claim:

1. A binding for connecting a boot to a ski, said binding being operative to release said boot from said ski when the environmental forces on said ski from skiing exceed a predetermined amount, said binding comprising:

a plate releasably affixed under said boot, said plate comprising:

(a) a first sphere downwardly extending from said plate, said first sphere being oriented on the longitudinal axis of said plate and under the ball area of said boot, and (b) a second sphere downwardly extending from said plate, said second sphere being oriented on said plate longitudinal axis and under the tibial axis of said boot, a first movable and arcuate tract mounted in a first recess formed in the upper surface of said ski, said first tract being capable of releasably engaging said first sphere, said first tract being further curved in an arc toward said second sphere, a second movable and arcuate tract mounted in a second formed recess in the upper surface of said ski, said second tract being capable of releasably engaging said second sphere, said second tract being further curved in an arc toward said first sphere, said first and second tracts being identical and symmetrical to each other and each comprising:

(a) a concave tract member, (b) a centering groove formed on the concave surface of said concave member, said concave centering groove having a partial spherical cavity in the center of the aforesaid groove, (c) means connected to said concave member and to said ski for biasing said concave member, (d) a convex tract member, (e) a centering groove formed on the convex surface of said convex member, said convex centering groove having a partial spherical cavity in the center of the aforesaid groove, (f) means connected to said convex member and to said ski for biasing said convex member toward said concave member, said concave member being spaced from said convex member to form said arcuate tract, said concave and convex centering grooves being capable of engaging said sphere and maintaining it aligned with the longitudinal axis of said ski in said partial spherical cavities under environmental forces less than said predetermined release force, said sphere being capable of traveling in said tract a predetermined distance in said concave and convex grooves when said environmental forces are less than said predetermined release force but greater than a predetermined travel force, said concave and convex centering grooves being capable of immediately returning said sphere to said longitudinal axis of said ski upon removal of said traveling forces, said concave and convex members being capable of releasing said sphere from said tract and in any direction above said ski when said environmental forces exceed said predetermined release force by moving against said concave and convex biasing means.

2. The binding of claim 1 further comprising a plurality of selectively insertable spacers between said concave and convex members and their respective biasing means to increase the tension in biasing and to selectively position the tract in relation to the ski to adjust to different boot sizes.

3. The binding of claim 1 wherein said convex and concave member biasing means are identical and comprise a plurality of coil springs.

4. A binding for connecting a boot to a ski, said binding being operative to release said boot from said ski when the environmental forces on said ski from skiing exceed a predetermined amount, said binding comprising:

first and second spheres, means for releasably affixing said first and second spheres to said boot, said first sphere downwardly extending from said boot and being oriented on the longitudinal axis of said boot and under the ball area of said boot, said second sphere downwardly extending from said boot and being oriented on said longitudinal axis of said boot and under the tibial axis of said boot, a first movable and arcuate tract mounted in a first recess formed in the upper surface of said ski, said first tract being capable of releasably engaging said first sphere, said first tract being further curved in an arc toward said second sphere, a second movable and arcuate tract mounted in a second formed recess in the upper surface of said ski, said second tract being capable of releasably engaging said second sphere, said second tract being further curved in an arc toward said first sphere, said first and second tracts being identical and symmetrical to each other and each comprising:

(a) a concave tract member, (b) a centering groove formed on the concave surface of said concave member, said concave centering groove having a partial spherical cavity in the center of the aforesaid groove, (c) means connected to said concave member and to said ski for biasing said concave member, (d) a convex tract member, (e) a centering groove formed on the convex surface of said convex member, said convex centering groove having a partial spherical cavity in the center of the aforesaid groove, (f) means connected to said convex member and to said ski for biasing said convex member toward said concave member, said concave member being spaced from said convex member to form said arcuate tract, said concave and convex centering grooves being capable of engaging said sphere and maintaining it aligned with the longitudinal axis of said ski in said partial spherical cavities under environmental forces less than said predetermined release force, said sphere being capable of traveling in said tract a predetermined distance in said concave and convex grooves when said environmental forces are less than said predetermined release force but greater than a predetermined travel force, said concave and convex centering grooves being capable of immediately returning said sphere to said longitudinal axis of said ski upon removal of said traveling forces, said concave and convex members being capable of releasing said sphere from said tract and in any direction above said ski when said environmental forces exceed said predetermined release force by moving against said concave and convex biasing means.

5. The binding of claim 4 further comprising a plurality of selectively insertable spacers between said concave and convex members and their respective biasing means to increase the tension in biasing and to selectively position the tract in relation to the ski to adjust to different boot sizes.

6. The binding of claim 4 wherein said convex and concave member biasing means are identical and comprise a plurality of coil springs.

7. A binding for connecting a boot to a ski, said binding being operative to release said boot from said ski when the environmental forces on said ski from skiing exceed a predetermined amount, said binding comprising:

first and second spheres, means for releasably affixing said first and second spheres to said boot, said first sphere downwardly extending from said boot and being oriented on the longitudinal axis of said boot and under the ball area of said boot, said second sphere downwardly extending from said boot and being oriented on said longitudinal axis of said boot and under the tibial axis of said boot, a first movable and arcuate tract mounted to the upper surface of said ski, said first tract being capable of releasably engaging said first sphere, said first tract being further curved in an arc toward said second sphere, a second movable and arcuate tract mounted to said upper surface of said ski said second tract being further curved in an arc toward said first sphere, said first and second tracts being identical and symmetrical to each other and each comprising:

(a) a concave tract member, (b) a centering groove formed on the concave surface of said concave member, said concave centering groove having a partial spherical cavity in the center of the aforesaid groove.

(c) means connected to said concave member and to said ski for biasing said concave member, (d) a convex tract member, (e) a centering groove formed on the convex surface of said convex member, said convex centering groove having a partial spherical cavity in the center of the aforesaid groove, (f) means connected to said convex member and to said ski for biasing said convex member toward said concave member, said concave member being spaced from said convex member to form said arcuate tract, said concave and convex centering grooves being capable of engaging said sphere and maintaining it aligned with the longitudinal axis of said ski in said partial spherical cavities under environmental forces less than said predetermined release force, said sphere being capable of traveling in said tract a predetermined distance in said concave and convex grooves when said environmental forces are less than said predetermined release force but greater than a predetermined travel force, said concave and convex centering grooves being capable of immediately returning said sphere to said longitudinal axis of said ski upon removal of said traveling forces, said concave and convex members being capable of releasing said sphere from said tract and in any direction above said ski when said environmental forces exceed said predetermined release force by moving against said concave and convex biasing means.

8. A non-exposed binding disposed entirely between a ski boot and the ski, said binding being operative to release said boot from said ski when the environmental forces on said ski from skiing exceed a predetermined amount, said binding comprising:

first means attached under said boot in the ball region of said boot for connecting to said ski, said first connecting means being oriented on the longitudinal axis of said boot, second means attached under said boot in the tibial axial region of said boot for connecting to said ski said second connecting means being oriented on said longitudinal axis of said boot, first means attached to said ski for engaging said first connection means in a mating relationship, said first engaging means cooperative with said first connecting means for releasing said first connecting means in any direction above said ski whenever said environmental forces exceed said predetermined amount, said first connecting means being capable of forward and rearward movement along the longitudinal axis of said ski and under bias in said first engaging means under said environmental forces, and second means attached to said ski for engaging said second connecting means in a mating relationship, said second engaging means cooperative with said second connecting means for releasing said second connecting means in any direction above said ski whenever said environmental forces exceed said predetermined amount, said second connecting means being capable of forward and rearward movement along the longitudinal axis of said ski and under bias in said second engaging means under said environmental forces.

9. The ski binding of claim 8 wherein said first protrusion means and said second connecting means are identical and said first engaging means and said second receiving means are identical.

10. A binding disposed entirely between a ski boot and the ski, said binding being operative to release said boot from said ski when the environmental forces on said ski from skiing exceed a predetermined amount, said binding comprising:

first means attached under said boot in the ball region of said boot for protruding downwardly, second means attached under said boot in the tibial axial region of said boot for protruding downwardly, first means connected to said ski for receiving said first protrusion means in a mating relationship, said first receiving means cooperative with said first protrusion means for independently releasing said first protrusion means whenever said environmental forces exceed said predetermined amount, and second means connected to said ski for receiving said second protrusion means in a mating relationship, said second receiving means cooperative with said second protrusion means for independently releasing said second protrusion means whenever said environmental forces exceed said predetermined amount, the bottom of said ski boot being held firmly against the top of said ski with no spacial separation existing between the two by and said first protruding and receiving means and said second protruding and receiving means being contained therebetween.

11. A binding disposed entirely between a ski boot and the ski, said binding being operative to release said boot from said ski when the environmental forces on said ski from skiing exceed a predetermined amount, said binding comprising:

first means attached under said boot in the ball region of said boot for protruding downwardly, second means attached under said boot in the tibial axial region of said boot for protruding downwardly, first means connected to said ski for receiving said first protrusion means in a mating relationship, said first receiving means cooperative with said first protrusion means for releasing said first protrusion means whenever said environmental forces exceed said predetermined amount, and second means connected to said ski for receiving said second protrusion means in a mating relationship, said second receiving means cooperative with said second protrusion means for releasing said second protrusion means whenever said environmental forces exceed said predetermined amount, said first protrusion means and said second protrusion means being identical and said first receiving means and said second receiving means being identical and said first receiving means and said second receiving means being identical.

12. The ski binding of claim 11 wherein said protrusion means are capable of releasing from said receiving means in any direction above said ski.

13. The binding of claim 11 wherein said first and second protruding means are oriented on the longitudinal axis of said boot.

14. A binding disposed entirely between a ski boot and the ski, said binding being operative to release said boot from said ski when the environmental forces on said ski from skiing exceed a predetermined amount, said binding comprising:

first means attached under said boot for connecting to said ski, said first connecting means being oriented substantially on the longitudinal axis of said boot, second means identical in configuration to said first means attached under said boot for connecting to said ski, said second connecting means being oriented substantially on said longitudinal axis of said boot, first means attached to said ski for engaging said first connection means in a mating relationship, said first engaging means cooperative with said first connecting means for releasing said first connecting means in any direction above said ski whenever said environmental forces exceed said predetermined amount, said first connecting means being capable of forward and rearward movement along the longitudinal axis of said ski in said first engaging means under said environmental forces, and second means identical to said first engaging means attached to said ski for engaging said second connecting means in a mating relationship, said second engaging means cooperative with said second connecting means for releasing said second connecting means in any direction above said ski whenever said environmental forces exceed said predetermined amount, said second connecting means being capable of forward or rearward movement along the longitudinal axis of said ski in said second engaging means under said environmental forces.

15. The binding of claim 14 wherein each of said first and second engaging means comprises:

a first biasing means abutting the rear of said associated connecting means, said first biasing means being capable of rearward movement along said longitudinal axis of said ski, a second biasing means abutting the front of said associated connecting means, said second biasing means being capable of forward movement along said longitudinal axis of said ski, said first and second biasing means providing anti-shock control through said forward and rearward movement when said environmental forces are below said predetermined amount and further providing release of said associated connecting means when said environmental forces exceed said predetermined amount.

16. The binding of claim 15 wherein said first connecting means is mounted in the ball region of said boot and wherein said second connecting means is mounted in the tibial axial region of said boot.

17. The binding of claim 14 wherein said first and second engaging means are contained entirely within the ski.

18. A ski binding for connecting the ski boot with a ski, said binding being operative to release said boot from said ski when the environmental forces on said ski from skiing exceed a predetermined amount, said binding comprising:

first means attached under said boot for connecting to said ski, said first connecting means being oriented substantially on the longitudinal axis of said boot, second means attached under said boot for connecting to said ski, said second connecting means being oriented substantially on said longitudinal axis of said boot, first means attached to said ski for engaging said first connection means in a mating relationship, said first engaging means cooperative with said first connecting means for releasing said first connecting means in any direction above said ski whenever said environmental forces exceed said predetermined amount, said first connecting means being capable of forward and rearward movement along the longitudinal axis of said ski when said first engaging means are under said environmental forces, said first engaging means comprising:

(a) a first biasing means abutting the rear of said first connecting means, said first biasing means being capable of rearward movement along the longitudinal axis of said ski, (b) a second biasing means abutting the front of said first connecting means, said second biasing means being capable of forward movement along said longitudinal axis of said ski, said first and second biasing means providing anti-shock control through said forward and rearward movement when said environmental forces are less than said predetermined amount and further providing release of said first connecting means when said environmental forces exceed said predetermined amount second means attached to said ski for engaging said second connecting means in a mating relationship, said second engaging means cooperative with said second connecting means for releasing said second connecting means in any direction above said ski whenever said environmental forces exceed said predetermined amount, said second connecting means being capable of forward or rearward movement along the longitudinal axis of the said ski in said second engaging means under environmental forces, said second engaging means comprising:

(a) a first biasing means abutting the rear of said second connecting means, the aforesaid first biasing means being capable of rearward movement along the longitudinal axis of said ski, (b) a second biasing means abutting the front of said second connecting means, said second biasing means being capable of forward movement along said longitudinal axis of said ski, the aforesaid first and second biasing means providing anti-shock control through said forward and rearward movement when said environmental forces are less than said predetermined amounts and further providing release for said second connecting means when said environmental forces exceed said predetermined amount.

* * * * *